US012533003B2

(12) United States Patent
Beckmann et al.

(10) Patent No.: US 12,533,003 B2
(45) Date of Patent: Jan. 27, 2026

(54) DRINKWARE CLEANING ASSEMBLY FOR A DISHWASHER APPLIANCE

(71) Applicant: Haier US Appliance Solutions, Inc., Wilmington, DE (US)

(72) Inventors: Mary Beckmann, Louisville, KY (US); Brian Michael Schork, Louisville, KY (US); Valerie Anderson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 32 days.

(21) Appl. No.: 18/419,191

(22) Filed: Jan. 22, 2024

(65) Prior Publication Data

US 2025/0235073 A1 Jul. 24, 2025

(51) Int. Cl.

| | |
|---|---|
| ***A47L 15/00*** | (2006.01) |
| ***A47L 15/42*** | (2006.01) |
| ***A47L 15/44*** | (2006.01) |

(52) U.S. Cl.

CPC ..... *A47L 15/0068* (2013.01); *A47L 15/4221* (2013.01); *A47L 15/4257* (2013.01); *A47L 15/4278* (2013.01); *A47L 15/44* (2013.01)

(58) Field of Classification Search

CPC ..... A47L 15/0065; A47L 15/0068; A47L 15/4221; A47L 15/4257; A47L 15/4278; A47L 15/44

See application file for complete search history.

(56) References Cited

U.S. PATENT DOCUMENTS

| | | | | |
|---|---|---|---|---|
| 3,903,911 | A * | 9/1975 | Guth | A47L 15/16 134/148 |
| 11,607,104 | B1 * | 3/2023 | Dunaway | A47L 15/16 |
| 11,944,255 | B2 * | 4/2024 | Boyer | A47L 15/0065 |
| 2019/0000300 | A1 | 1/2019 | Anim-Mensah et al. | |
| 2023/0142445 | A1 | 5/2023 | Kim et al. | |
| 2023/0301486 | A1 | 9/2023 | Boyer et al. | |

FOREIGN PATENT DOCUMENTS

| | | | |
|---|---|---|---|
| CN | 106377211 | A | 2/2017 |
| KR | 20160093971 | A | 8/2016 |
| KR | 102431481 | B1 | 8/2022 |
| WO | WO2014107123 | A1 | 7/2014 |

OTHER PUBLICATIONS

CN 106377211 by Huang—translation (Year: 2017).*
KR 0114028 by Kim—translation (Year: 1998).*

* cited by examiner

*Primary Examiner* — Michael E Barr

(74) *Attorney, Agent, or Firm* — Dority & Manning, P.A.

(57) ABSTRACT

A dishwasher appliance may include a tub defining a wash chamber. The dishwasher appliance may also include a fluid circulation assembly for circulating water and wash fluid in the tub. The dishwasher appliance may further include a door mounted to the tub. The door may be movable between an open position in which access to the tub is permitted and a closed position in which access to the tub is restricted. The dishwasher appliance may further include a detergent storage chamber for storing detergent. The dishwasher appliance may also include a drinkware cleaning assembly attached to an inside surface of the door. The drinkware cleaning assembly may include a dispenser assembly in fluid communication with the fluid circulation assembly and the detergent storage chamber to dispense water provided by the fluid circulation assembly or detergent provided by the detergent storage chamber.

17 Claims, 5 Drawing Sheets

DRINKWARE CLEANING ASSEMBLY FOR A DISHWASHER APPLIANCE

FIELD OF THE DISCLOSURE

The present subject matter relates generally to a dishwasher appliance, and more particularly to a cleaning assembly for a dishwasher appliance.

BACKGROUND OF THE DISCLOSURE

Dishwasher appliances generally include a tub that defines a wash chamber therein. Various spray assemblies may be disposed within the wash chamber. During operation of the dishwasher appliances, the spray assemblies direct wash fluid towards articles within rack assemblies in the wash chamber. Thus, the spray assemblies provide multiple outlets for directing wash fluid onto articles within the rack assemblies during operation of the dishwasher appliances.

However, challenges related to the cleaning of drinkware articles (e.g., cups, bottles, jars, etc.), particularly, with a dishwasher appliance, currently exist. For example, a user of a dishwasher appliance may wish to clean a single drinkware article. Typically, the user can decide to handwash the drinkware article or run a wash cycle of the dishwasher appliance to clean the drinkware article. Handwashing of the drinkware article can be a laborious task. For instance, handwashing can require a user to fill a kitchen sink full of water or, if the sink is full of articles, maneuver around said articles to clean the single drinkware article. Running a wash cycle of the dishwasher appliance can be a lengthy task. For instance, the wash cycle may be required to run for a predetermined amount of time to clean the single drinkware articles.

Accordingly, systems and methods that obviate the above-mentioned drawbacks would be useful.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a dishwasher appliance is provided. The dishwasher appliance may include a tub defining a wash chamber. The dishwasher appliance may also include a fluid circulation assembly for circulating water and wash fluid in the tub. The dishwasher appliance may further include a door mounted to the tub. The door may be movable between an open position in which access to the tub is permitted and a closed position in which access to the tub is restricted. The dishwasher appliance may further include a detergent storage chamber for storing detergent. The dishwasher appliance may also include a drinkware cleaning assembly attached to an inside surface of the door. The drinkware cleaning assembly may include a dispenser assembly in fluid communication with the fluid circulation assembly and the detergent storage chamber to dispense water provided by the fluid circulation assembly or detergent provided by the detergent storage chamber.

In another exemplary aspect of the present disclosure, a drinkware cleaning assembly for a dishwasher appliance is provided. The dishwasher appliance may include a tub, a fluid circulation assembly, a door mounted to the tub, and a detergent storage chamber. The door may be movable between an open position and a closed position. The drinkware cleaning assembly may include a dispenser assembly attached to an inside surface of the door. The dispenser assembly being in fluid communication with the fluid circulation assembly and the detergent storage chamber to dispense water provided by the fluid circulation assembly or detergent from the detergent storage chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
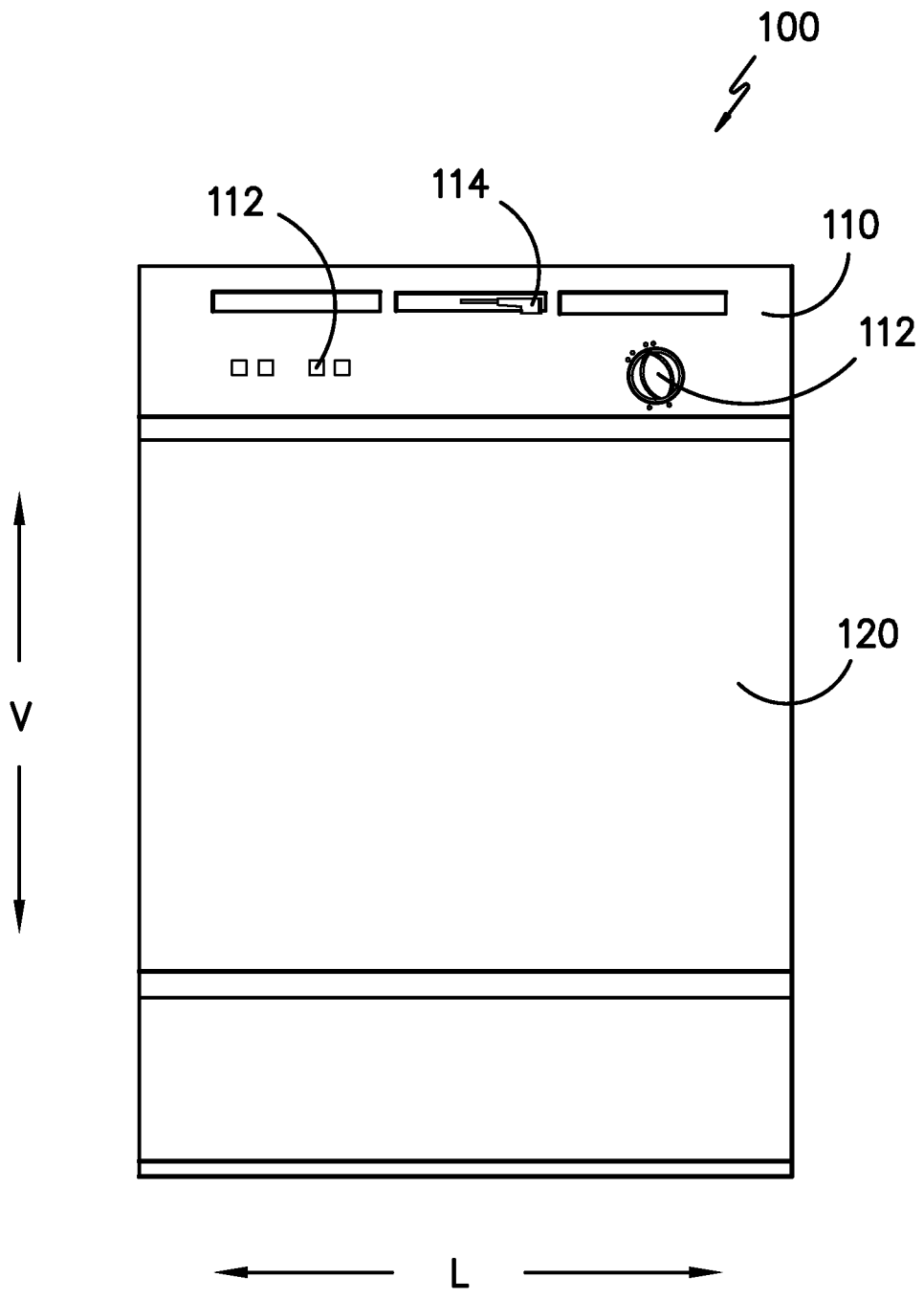
FIG. 1 provides a front elevation view of a dishwasher appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined or interchanged.

Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

As used herein, the term "article" may refer to, but need not be limited to dishes, pots, pans, silverware, and other cooking utensils and items that can be cleaned in a dishwashing appliance. The term, "drinkware," "glassware," and the like may include but need not be limited to glasses, cups, bottles, jars, and other drinking vessels which may be cleaned in a dishwashing appliance.

Exemplary aspects of the present subject matter advantageously provide a drinkware cleaning assembly integrated into a door of a dishwasher appliance. The exemplary drinkware cleaning assembly advantageously allows a user to quickly and effectively clean (e.g., with detergent and water) a single article (e.g., a drinkware article such as a bottle, glass, jar, etc.). Thus, a user can avoid having to run a complete wash cycle of the dishwasher appliance to have an article cleaned. Additionally or alternatively, a user can avoid having to fill a kitchen sink with wash fluid to handwash an article. Moreover, a physical cleaning aid can be removable attached to the drinkware cleaning assembly to advantageously provide a deeper clean of the article.

Figure 2:
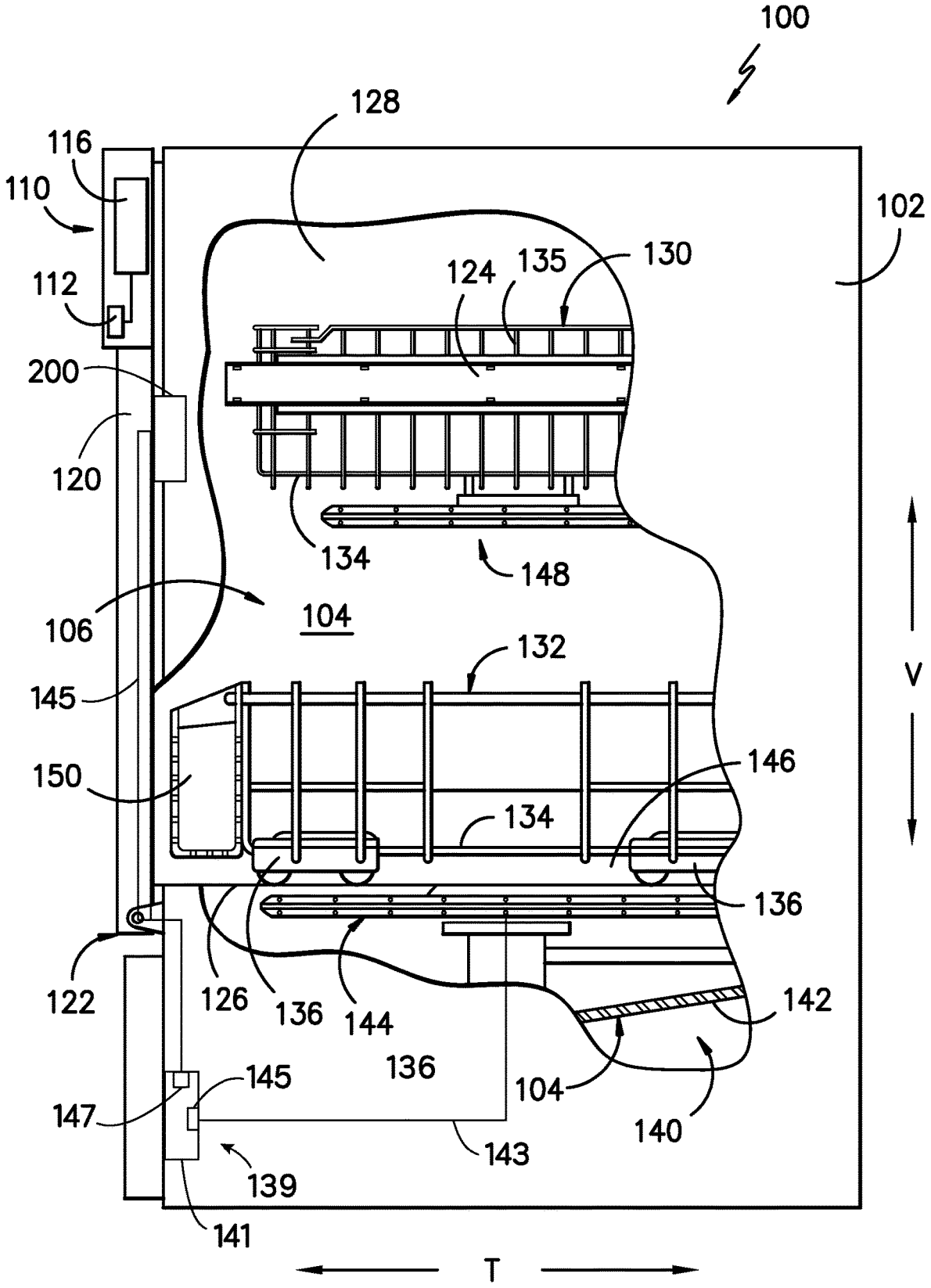
FIG. 2 provides a partial side section view of a dishwasher appliance according to one or more exemplary embodiments of the present subject matter.

FIGS. 1 and 2 depict a dishwasher appliance 100 according to an exemplary embodiment of the present subject matter. Dishwasher appliance 100 defines a vertical direction V, a lateral direction L (FIG. 1) and a transverse direction T (FIG. 2). The vertical, lateral, and transverse directions V, L, and T are mutually perpendicular and form an orthogonal direction system.

Dishwasher appliance 100 includes a chassis or cabinet 102 having a tub 104. Tub 104 defines a wash chamber 106 and includes a front opening (not shown) and a door 120 hinged at its bottom 122 for movement between a normally closed vertical position (shown in FIGS. 1 and 2), wherein wash chamber 106 is sealed shut for washing operation, and a horizontal open position for loading and unloading of articles from dishwasher appliance 100. A latch 114 is used to lock and unlock door 120 for access to chamber 106.

Slide assemblies 124 are mounted on opposing tub sidewalls 128 to support and provide for movement of an upper rack assembly 130. Lower guides 126 are positioned in opposing manner of the sides of chamber 106 and provide a ridge or shelf for roller assemblies 136 so as to support and provide for movement of a lower rack assembly 132. Each of the upper and lower rack assemblies 130 and 132 is fabricated into lattice structures including a plurality of elongated members 134 and 135 that extend in the lateral direction L, the transverse direction T, or the vertical direction V. Each rack assembly 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by slide assemblies 124 and roller assemblies 136 that carry the upper and lower rack assemblies 130 and 132, respectively. A silverware basket 150 may be removably attached to the lower rack assembly 132 for placement of silverware, small utensils, and the like, that are too small to be accommodated by the upper and lower rack assemblies 130, 132.

Dishwasher appliance 100 also includes a lower spray assembly 144 that is rotatably mounted within a lower region 146 of the wash chamber 106 and above a tub sump portion 142 so as to rotate in relatively close proximity to lower rack assembly 132. A spray arm or mid-level spray assembly 148 is located in an upper region of the wash chamber 106 and may be located in close proximity to upper rack assembly 130. Additionally, an upper spray assembly (not shown) may be located above the upper rack assembly 130 and mounted to an upper wall of tub 104.

Lower and mid-level spray assemblies 144, 148 and the upper spray assembly are fed by a fluid circulation assembly 139 for circulating water and wash fluid in the tub 104. The fluid circulation assembly 139 may include a water supply inlet valve assembly 141, a main water line 143, and a door water line 145. The water supply inlet valve assembly 141 may be in fluid communication with a water source (e.g., a water supply such as a municipal water supply or a well). The water supply inlet valve assembly 141 may selectively control a flow of water from the water source to the tub 104 or a drinkware cleaning assembly 200 (e.g., described in more detail below). For example, the water supply inlet valve assembly 141 may include a main valve 145 configured to selectively permit a flow of water to the tub 104 and a door valve 147 configured to selectively permit a flow of water to the drinkware cleaning assembly 200.

In some embodiments, the water supply inlet valve assembly 141 is in operative communication with a controller (e.g., controller 166 described in more detail below). The controller may be programmed to selectively open or close one or more valves (e.g., the main valve 145 or the door valve 147) of the water supply inlet valve assembly 141 during one or more stages of a wash cycle or a drinkware cleaning sequence (e.g., described in more detail below).

The main water line 143 (e.g., shown in FIG. 2) may be in fluid communication between the main valve 145 of the water supply inlet valve assembly 141 and the tub 104. For instance, the main water line 143 may be in fluid communication with each spray assembly. For example, as illustrated in FIG. 2, the main water line 143 may be in fluid communication with the lower spray assembly 144. As is generally recognized in the art, at least a portion of the fluid circulation assembly 139 may be located in a machinery compartment 140 located below tub sump portion 142 of tub 104.

Each spray assembly includes an arrangement of discharge ports or orifices for directing washing liquid onto dishes or other articles located in upper and lower rack assemblies 130, 132, respectively. The arrangement of the discharge ports in at least the lower spray assembly 144 provides a rotational force by virtue of washing fluid flowing through the discharge ports. The resultant rotation of lower spray assembly 144 provides coverage of dishes and other articles with a washing spray.

Additionally, the door water line 145 of the fluid circulation assembly 139 may convey water from the door valve 147 of the water supply inlet valve assembly 141 to a drinkware cleaning assembly 200 attached to an inside surface 121 of the door 120. In some embodiments, the door water line 145 is routed into the door 120 through bottom 122 of the door 120. For instance, the door water line 145 may be routed into the door 120 at the hinge located at the bottom 122 of the door 120. Thus, to ensure a robust door water line 145 that is capable of bending or hinging when the door 120 is moved between the open and closed positions, the door water line 145 may be constructed from a fatigue resistant tubing (e.g., a tubing constructed from a polymer such as polypropylene). Alternatively, in some embodiments, the door water line 145 may be provided as or include an auxiliary water line that is fed off from the main water line 143.

Dishwasher appliance 100 is further equipped with a controller 116 to regulate operation of dishwasher appliance 100. Controller 116 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 116 may be constructed without using a microprocessor, e.g., using a combination of discrete analog or digital logic circuitry (such as switches, amplifiers, integrators, comparators, flip-flops, AND gates, and the like) to perform control functionality instead of relying upon software.

Controller 116 may be positioned in a variety of locations throughout dishwasher appliance 100. In the illustrated embodiment, controller 116 may be located within a control panel area 110 of door 120 as shown. In such an embodiment, input/output ("I/O") signals may be routed between the control system and various operational components of dishwasher appliance 100 along wiring harnesses that may be routed through bottom 122 of door 120. Typically, the controller 116 includes a user interface panel 112 through which a user may select various operational features and modes and monitor progress of the dishwasher appliance 100. In one embodiment, user interface panel 112 may represent a general purpose I/O ("GPIO") device or functional block. In one embodiment, the user interface panel 112 may include input components, such as one or more of a variety of electrical, mechanical or electro-mechanical input devices including rotary dials, push buttons, and touch pads. User interface panel 112 may include a display component, such as a digital or analog display device designed to provide operational feedback to a user. User interface panel 112 may be in communication with controller 116 via one or more signal lines or shared communication busses.

It should be appreciated that the present subject matter is not limited to any particular style, model, or configuration of dishwasher appliance. Thus, the exemplary embodiment depicted in FIGS. 1 and 2 is provided for illustrative purposes only. For example, different locations may be provided for a user interface 112, different configurations may be provided for upper and lower rack assemblies 130, 132 or lower and mid-level spray assemblies 144, 148, and other differences may be applied as well.

According to one or more exemplary aspects of the present subject matter, the drinkware cleaning assembly 200 may advantageously be attached to an inside surface 121 of the door 120. The drinkware cleaning assembly 200 may advantageously allow a user of the dishwasher appliance to quickly clean a single drinkware article (e.g., a single glass, cup, bottle, jar, etc.) when the door 120 is in the open position. Moreover, the drinkware cleaning article may advantageously use a chemical cleaning aid (e.g., liquid detergent), a physical cleaning aid (e.g., scrubbing ring) or water to quickly clean the single drinkware article.

Figure 3:
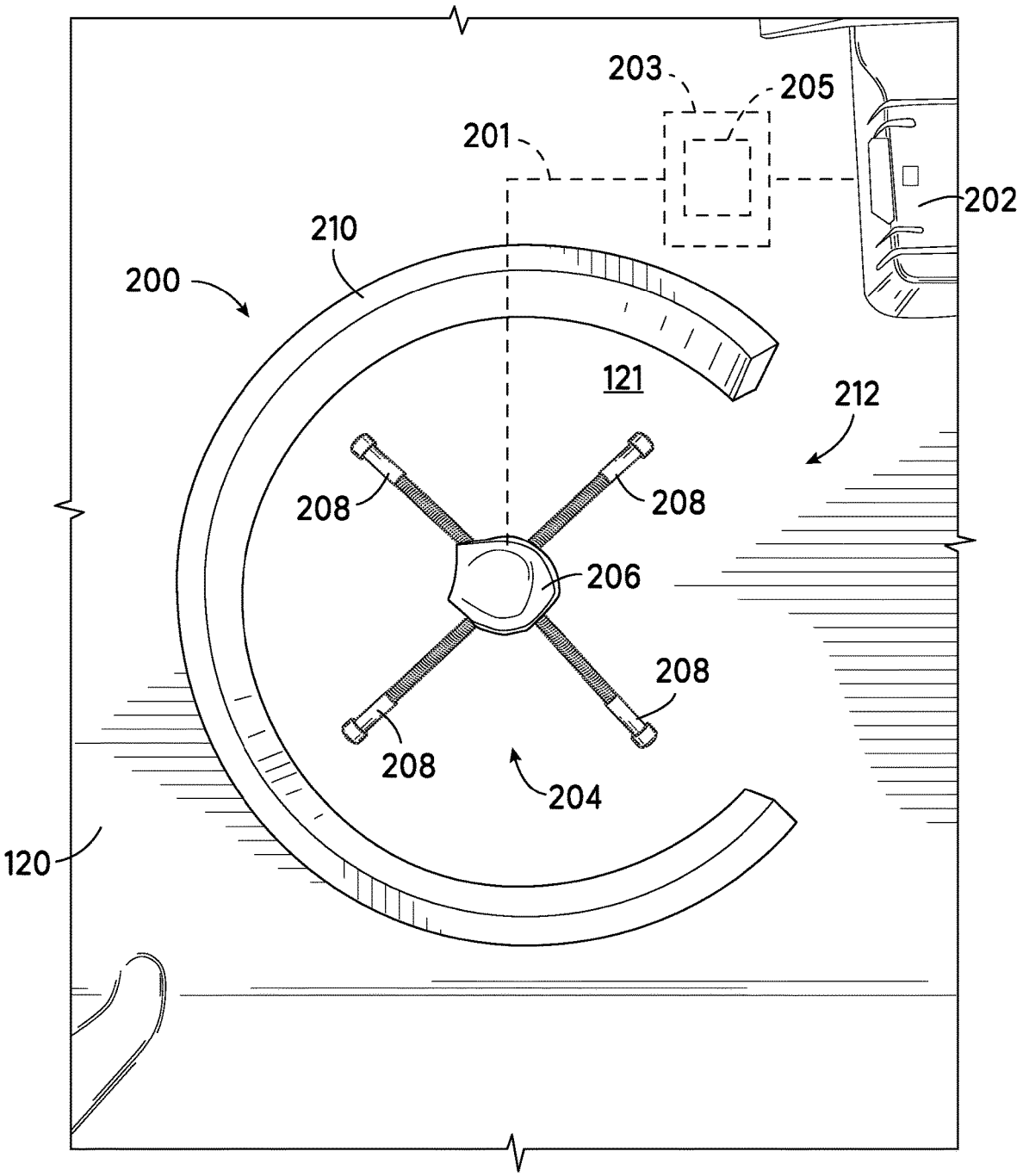
FIG. 3 provides a top-down view of a drinkware cleaning assembly attached a door of the dishwasher appliance of FIG. 1 according to one or more exemplary embodiments of the present subject matter.

Referring now to FIG. 3, a top-down view of the drinkware cleaning assembly 200 is provided. Generally, the drinkware cleaning assembly 200 may be in fluid communication with the fluid circulation assembly 139 (see, e.g., FIG. 2) or a detergent storage chamber 202. As illustrated in FIG. 3, the detergent storage chamber 202 may be positioned within, or attached to, the door 120. The detergent storage chamber 202 may generally be configured to hold a volume of detergent for use during one or more wash cycles or drinkware cleaning sequences.

Additionally or alternatively, dishwasher appliance 100 may include a bulk detergent storage chamber also in fluid communication with the drinkware cleaning assembly 200. The bulk detergent storage chamber may be configured to hold a relatively large volume of detergent. For instance, the bulk detergent storage chamber may hold or store a volume of detergent that is large enough for multiple wash cycles or drinkware cleaning sequences.

The exemplary drinkware cleaning assembly 200 may advantageously be integrated into the door 120 of the dishwasher appliance 100. Additionally or alternatively, the drinkware cleaning assembly 200 may include a dispenser assembly 204 that is in fluid communication with both the door water line 145 and the detergent storage chamber 202. As will be appreciated, the dispenser assembly 204 may dispense detergent (e.g., a liquid detergent that may be stored within the detergent storage chamber 202) or water (e.g., water provided via the door water line 145) into a drinkware article placed over the dispenser assembly, for instance, to clean the drinkware article.

In some embodiments, the dispenser assembly 204 includes a nozzle 206 extended through the inside surface 121 of the door 120. The nozzle 206 may generally be provided for dispensing detergent or water into a drinkware article that may be placed over the nozzle 206. The nozzle 206 may be in direct fluid communication with the detergent storage chamber 202 via a detergent line 201. Additionally or alternatively, the nozzle 206 may be in direct fluid communication with the water supply inlet valve assembly 141 via the door water line 145. In some embodiments, a pump assembly 203 is located within the door 120 and is in fluid communication with the nozzle 206 for selectively discharging detergent from the detergent storage chamber. The pump assembly 203 may generally include a detergent pump 205 which is in fluid communication with the detergent storage chamber and the nozzle 206 through the detergent line 201. During a drinkware cleaning sequence (e.g., described in more detail below), detergent pump 205 urges a flow of detergent from the detergent storage chamber 202, through detergent line 201, and to nozzle 206. More specifically, detergent pump 205 includes a motor (not shown), which is energized during the drinkware cleaning sequence such that the detergent pump 205 draws detergent from the detergent storage chamber 202 and urges it through detergent line 201 to nozzle 206.

Optionally, the nozzle 206 may include one or more aerating components (not shown) therewithin. As is generally recognized in the art, aerating components may be configured to aerate or "foam" detergent prior to the detergent being dispensed. For example, the one or more aerating components may include an aerating screen that may create turbulence within the detergent as the detergent passes through small holes defined by the aerating screen. Thus, a "foaming" detergent may be dispensed from the nozzle 206.

In some embodiments, the drinkware cleaning assembly 200 includes an actuating device coupled to nozzle 206. Generally, the actuating device may be any suitable device, or device(s) that are configured to trigger the nozzle 206 to dispense water or detergent. For example, as illustrated in FIG. 3, the actuating device may be a plurality of actuating arms 208. Each actuating arm 208 of the plurality of actuating arms 208 may be extended outward from the nozzle 206. The plurality of actuating arms 208 may be spaced apart circumferentially around the nozzle 206. Each actuating arm 208 of the plurality of actuating arms 208 may be actuatable relative to nozzle 206. For instance, each actuating arm 208 of the plurality of actuating arms 208 may be actuatable downward (e.g., toward the inside surface 121 of the door 120) relative to the nozzle 206.

As another example, the actuating device may be an actuating frame or plate. In such exemplary embodiments, the nozzle 206 may be positioned at a center of the actuating frame or plate, such as through a center of the actuating frame or plate. The actuating frame or plate may be slidable attached to the door 120. For instance, the actuating frame or plate may be actuatable downward relative to the nozzle 206. In this regard, when a drinkware article is positioned on or over the actuating frame or plate, a user may be capable of actuating the frame or plate while having the nozzle positioned within the drinkware article.

In some embodiments, the plurality of actuating arms 208 may be in operative communication with the controller 166. For instance, in such embodiments a sensor (e.g., a reed switch or a hall effect sensor) may be operatively coupled to the plurality of actuating arms 208 to detect a position of the plurality of actuating arms 208. When it has been detected that the plurality of actuating arms 208 have been actuated, for example, by a drinkware article being placed over the plurality of actuating arms 208, the sensor may send a signal the controller 166. The signal sent to the controller 166 may prompt the controller 166 to begin a drinkware cleaning sequence, as will be described in more detail below.

Additionally, the drinkware cleaning assembly 200 may include a perimeter wall 210 attached directly to the inside surface 121 of the door 120. The perimeter wall 210 may be positioned around the nozzle 206 and actuating device (e.g., the plurality of actuating arms 208). The perimeter wall 210 may define a drainage opening for directing water or detergent toward the tub 104. Further, the perimeter wall 210 may function as a locating feature for drinkware articles. For instance, the crescent shape of the perimeter wall 210 may be utilized to locate drinkware articles toward the nozzle 206 and the plurality of actuating arms 208. Additionally, the perimeter wall 210 may define a height 214 (see, for example, FIG. 4). The height 214 of the perimeter wall 210 may be configured to reduce or mitigate accidentally triggering of the plurality of trigger arms 208. For example, the height 214 of the perimeter wall 210 may be at least two times a height of the nozzle 206.

Figure 4:
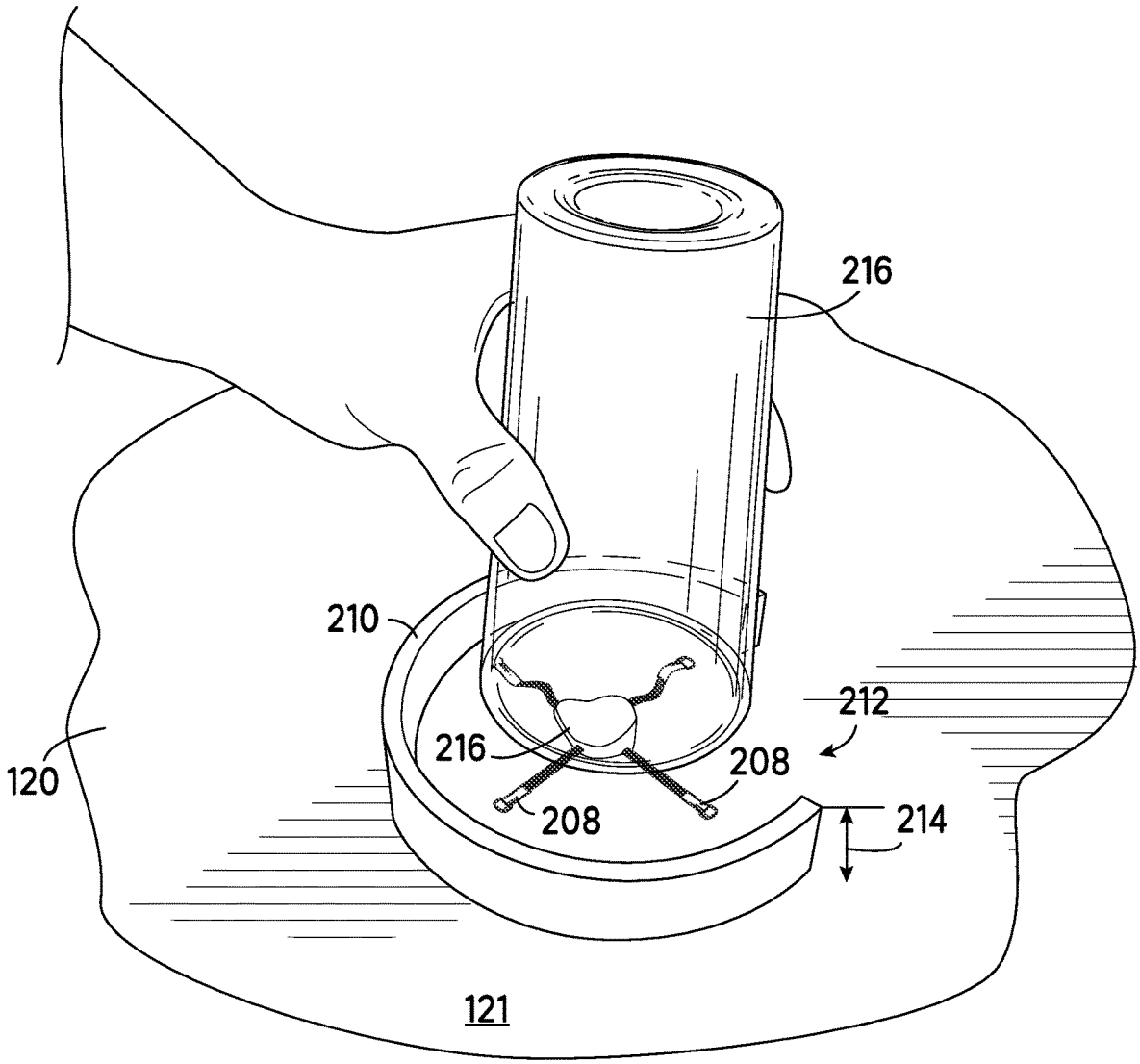
FIG. 4 provides an illustrative example of a drinkware cleaning sequence of the drinkware cleaning assembly of FIG. 3.

Referring now to FIG. 4, an illustrative example of a drinkware cleaning sequence is provided. The drinkware cleaning sequence may be utilized to quickly clean a drinkware article, e.g., a glass, a cup, a bottle, a jar, etc. Generally, the drinkware cleaning sequence includes the dispensing of detergent from the nozzle 206 into a drinkware article (e.g., a glass 216 as shown in FIG. 4) followed by the dispensing of water to rinse the detergent from the drinkware article. In some embodiments, the drinkware cleaning sequence may only be initiated when the door 120 is in a fully open position. In the fully open position, the door 120 may be "fully opened" or opened to a maximum angular position allowed by a hinge of the door 120. For instance, the fully open position of the door 120 may correspond to the door 120 being at an approximately ninety-degree angle to the cabinet 102. In some embodiments, the door 120 may be in operative communication with any suitable sensor configured to determine the angular position of the door 120. For instance, the door 120 may be in operative communication with an angle sensor, an infrared sensor, a hall effect sensor, etc. When the sensor detects that the door 120 is in the fully open position, a signal may be sent to controller 166 indicating that the door 120 is in the fully open position. Further, when the signal indicating the door 120 is in the fully open position is received by the controller 166, the controller 166 may then open the door valve 147 (e.g., as motivated by a corresponding solenoid or motor) of the water supply inlet valve assembly 141. In this regard, water may be selectively conveyed to the drinkware cleaning assembly 200.

Additionally or alternatively, in some other embodiments, the door 120 is in the open position when the latch 114 is unlocked. The latch 114 may be in operative communication with the controller 166. When the latch 114 is locked, a signal may be sent to the controller 166 indicating that the door 120 is in the closed position. Conversely, when the latch 114 is unlocked, a signal may be sent to the controller 166 indicating that the door 120 is in the open position. Further, when the signal indicating the door 120 is in the open position is received by the controller 166, the controller 166 may then open the door valve 147 (e.g., as motivated by a corresponding solenoid or motor) of the water supply inlet valve assembly 141. In this regard, water may be selectively conveyed to the drinkware cleaning assembly 200.

Further, when the door 120 is in the open position, a user may place the lip of a drinkware article, for instance, the glass 216, above the plurality of actuating arms 208. The user may use the glass 216 to push the plurality of actuating arms 208 downward toward the door 120 (e.g., actuate the plurality of actuating arms 208). The actuation of the plurality of actuating arms 208 may initiate the drinkware cleaning sequence. For instance, when the plurality of actuating arms 208 are actuated, a signal may be sent to the pump assembly 203 (see, e.g., FIG. 3) to pump a predetermined amount of detergent toward the nozzle 206 for dispensing. As the detergent is pumped through the nozzle 206, the one or more aerating features may aerate or foam the detergent. The aerated or foamed detergent may be dispensed through the nozzle 206 and may coat the inside of the drinkware article (e.g., the glass 216) that may be positioned around it. In some embodiments, the detergent may include a chemical surfactant, such as Sodium Lauryl Sulfate or any other suitable surfactant. In this regard, the detergent may break down any liquids, stains, dirt, grease, etc., that may be in the drinkware article.

Additionally, after the detergent has been dispensed into the drinkware article, the drinkware cleaning sequence may include dispensing water through the nozzle 206. For instance, the door valve 147 of the water inlet supply valve assembly 141 may be opened, such that water may be conveyed toward the nozzle 206. The water dispensed via the nozzle 206 may be used to rinse the detergent out of the drinkware article. In some embodiments, water may be dispensed for a predetermined amount of time into the drinkware article to rinse the drinkware article. In other embodiments, a predetermined amount of water may be sprayed or dispensed into the drinkware article to rinse the drinkware article. In some other embodiments, water may be dispensed indefinitely as long as the plurality of actuating arms 208 are depressed.

After the water has rinsed the detergent out of the drinkware article, the drinkware cleaning sequence may then be complete. As should be appreciated, the perimeter wall 210 may direct detergent or water that was dispensed into the drinkware article toward the tub 104. For instance, when the door 120 is moved to the closed position, the drainage opening 212 of the perimeter wall 210 may direct collected detergent or water toward the drainage system positioned within the tub.

Figure 5:
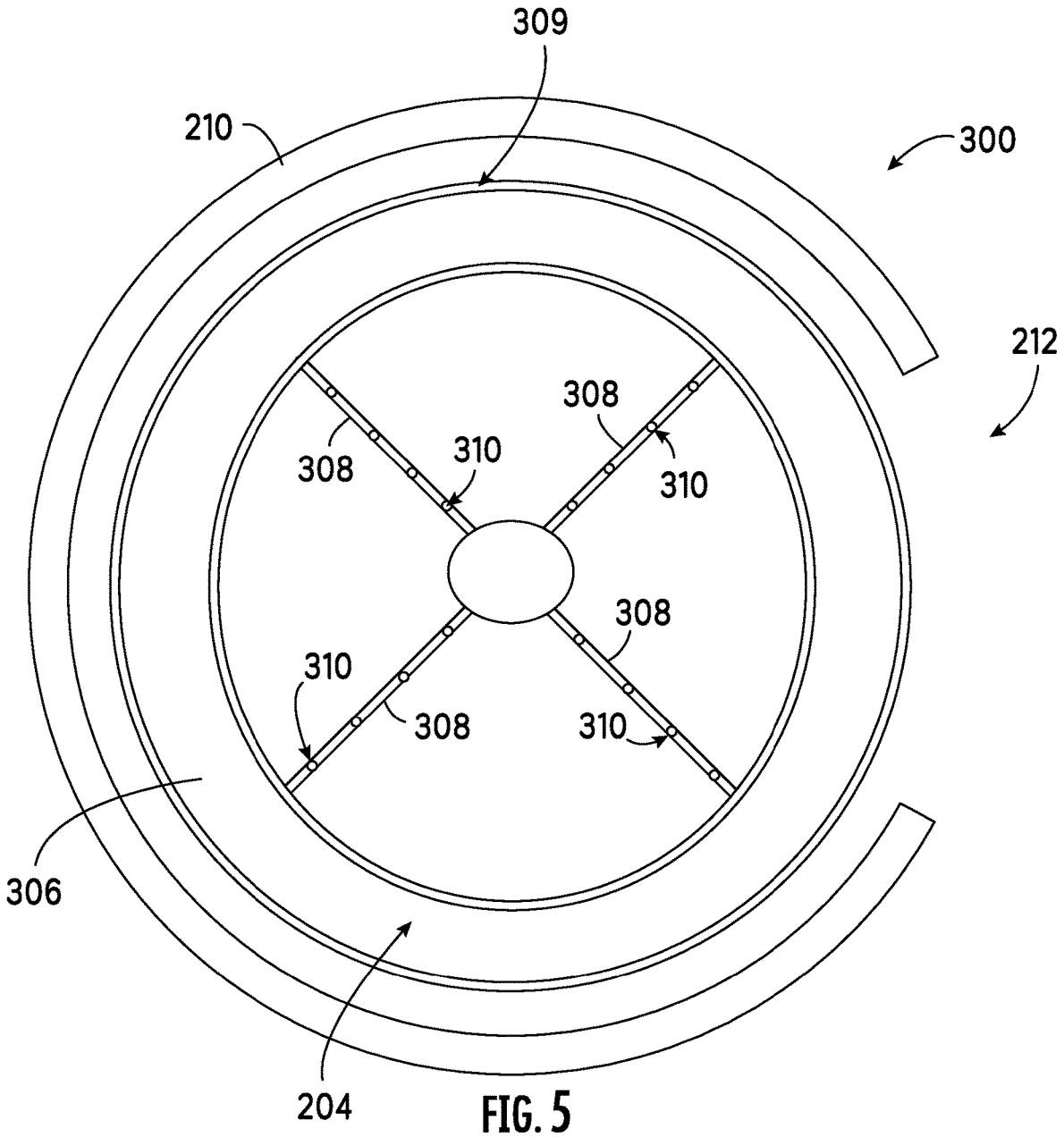
FIG. 5 provides a schematic view of an alternative drinkware cleaning assembly according to one or more exemplary embodiments of the present subject matter.

Referring now to FIG. 5, a schematic top-down view of a drinkware cleaning assembly 300 according to one or more exemplary aspects of the present subject matter is provided. The exemplary drinkware cleaning assembly 300 of FIG. 5 may be configured in substantially the same manner as the exemplary drinkware cleaning assembly 200 of FIG. 4, and accordingly, the same or similar numbers may refer to the same or similar parts. For example, the exemplary drinkware cleaning assembly 300 of FIG. 5 may include dispenser assembly 204 for dispensing water or detergent, an actuating device for triggering the dispenser assembly 204, and a perimeter wall 210 defining a drainage opening 212. However, for the embodiment of FIG. 5, the actuating device is now configured as an actuating floor 306.

The actuating floor 306 may be actuatable to trigger the drinkware cleaning sequence. For instance, a user may push the actuating floor downward to actuate the actuating floor 306. Further, for the embodiment of FIG. 5, the dispenser assembly 204 may include a plurality of dispensing arms 308 thar are each configured to dispense the detergent or water, for instance, into a drinkware article positioned above the dispenser assembly 204. For instance, each dispensing arm 308 may define a fluid passage therewithin. Each fluid passage may be in fluid communication with a detergent storage chamber (e.g., the detergent storage chamber 202) or a door water line (e.g., the door water line 145). Additionally or alternatively, each dispensing arm 308 may include a plurality of perforations 310 defined there though. The plurality of perforations 310 may be in fluid communication with the fluid passage within the dispensing arm 308. In this regard, during the drinkware cleaning sequence, water or detergent may be dispensed into a drinkware article positioned above the dispensing assembly 204.

Additionally or alternatively, and as shown in FIG. 5, the drinkware cleaning assembly 200 may define a scrubbing ring 309. Particularly, the scrubbing ring 309 may be defined within the actuating floor 306. For instance the scrubbing ring 309 may be a groove within the actuating floor 306 that a lip of a drinkware article, e.g., the lip of a cup, glass, bottle, jar, etc., may be positioned within. Further, the scrubbing ring 309 may be capable of receiving one or more physical cleaning aids therewithin. For instance, the physical cleaning aid may include bristles, a sponge, or another suitable material that may be configured to physically clean or remove dirt or grime from the lip of a drinkware article. For example, cleaning bristles of the physical cleaning aid may be extended into the scrubbing ring 309. In this regard, when the lip of a drinkware article is positioned within the scrubbing ring 309, the inside and outside surface of the lip of the drinkware articles may be physically scrubbed, and in turn, cleaned.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance comprising:

a tub defining a wash chamber;

a fluid circulation assembly for circulating water and wash fluid in the tub;

a door mounted to the tub, the door movable between an open position in which access to the tub is permitted and a closed position in which access to the tub is restricted;

a detergent storage chamber for storing detergent; and a drinkware cleaning assembly attached to an inside surface of the door, the drinkware cleaning assembly comprising:

a dispenser assembly in fluid communication with the fluid circulation assembly and the detergent storage chamber to dispense water provided by the fluid circulation assembly or detergent provided by the detergent storage chamber, the dispenser assembly comprising a nozzle coupled to the inside surface of the door, the nozzle in fluid communication with the fluid circulation assembly or the detergent storage chamber to selectively dispense water or detergent when the door is in the open position; and a scrubbing ring defined within the door, wherein the scrubbing ring is positioned around the nozzle.

2. The dishwasher appliance of claim 1, wherein the nozzle is an aerating nozzle for aerating detergent.

3. The dishwasher appliance of claim 1, wherein the dispenser assembly further comprises an actuating device coupled to the nozzle, whereby a drinkware cleaning sequence is initiated when the actuating device is actuated.

4. The dishwasher appliance of claim 3, wherein the actuating device comprises a plurality of actuating arms, wherein each actuating arm is extended outward from the nozzle, wherein the plurality of actuating arms are each actuatable relative to nozzle.

5. The dishwasher appliance of claim 1, wherein the drinkware cleaning assembly further comprises a perimeter wall attached directly to the door, and wherein the perimeter wall is positioned around the nozzle.

6. The dishwasher appliance of claim 5, wherein the perimeter wall defines a drainage opening.

7. The dishwasher appliance of claim 1, wherein the nozzle further comprises a plurality of dispensing arms, wherein each dispensing arm is in fluid communication with the nozzle, and wherein each dispensing arm defines a plurality of perforations.

8. The dishwasher appliance of claim 1, wherein the drinkware cleaning assembly further comprises a physical cleaning aid, wherein the physical cleaning aid is selectively attached to the door within the scrubbing ring.

9. The dishwasher appliance of claim 1, wherein the fluid circulation assembly comprises a main water valve and a door water line, wherein water is provided to the tub via the main water valve when the door is in the closed position, and wherein water is provided to the drinkware cleaning assembly when the door is in the open position.

10. A drinkware cleaning assembly for a dishwasher appliance, the dishwasher appliance comprising a tub, a fluid circulation assembly, a door mounted to the tub, and a detergent storage chamber, the door movable between an open position and a closed position, the drinkware cleaning assembly comprising:

a dispenser assembly attached to an inside surface of the door, the dispenser assembly being in fluid communication with the fluid circulation assembly and the detergent storage chamber to dispense water provided by the fluid circulation assembly or detergent from the detergent storage chamber, the dispenser assembly comprising a nozzle coupled to the inside surface of the door, the nozzle in fluid communication with the fluid circulation assembly or the detergent storage chamber to selectively dispense water or detergent when the door is in the open position; and a scrubbing ring defined within the door, wherein the scrubbing ring is positioned around the nozzle.

11. The drinkware cleaning assembly of claim 10, wherein the dispenser assembly further comprises an actuating device coupled to the nozzle, whereby a drinkware cleaning sequence is initiated when the actuating device is actuated.

12. The drinkware cleaning assembly of claim 11, wherein the actuating device comprises a plurality of actuating arms, wherein each actuating arm is extended outward from the nozzle, wherein the plurality of actuating arms are each actuatable relative to nozzle.

13. The drinkware cleaning assembly of claim 10, wherein the drinkware cleaning assembly further comprises a perimeter wall attached directly to the door, and wherein the perimeter wall is positioned around the nozzle.

14. The drinkware cleaning assembly of claim 13, wherein the perimeter wall defines a drainage opening.

15. The drinkware cleaning assembly claim 10, wherein the nozzle further comprises a plurality of dispensing arms, wherein each dispensing arm is in fluid communication with the nozzle, and wherein each dispensing arm defines a plurality of perforations.

16. The drinkware cleaning assembly of claim 10, wherein the drinkware cleaning assembly further comprises a physical cleaning aid, wherein the physical cleaning aid is selectively attached to the door within the scrubbing ring.

17. The drinkware cleaning assembly of claim 10, wherein the fluid circulation assembly comprises a main water valve and a door water line, wherein water is provided to the tub via the main water valve when the door is in the closed position, and wherein water is provided to the drinkware cleaning assembly when the door is in the open position.

* * * * *